US005794287A

United States Patent [19]

Chung

[11] Patent Number: 5,794,287

[45] **Date of Patent: *Aug. 18, 1998**

[54] WATER BAG OF A WATER BED

[76] Inventor: Ming-Chun Chung, 7F, No. 22, Alley 3, Lane 227, Nung An Street, Taipei, Taiwan

[ * ] Notice: The term of this patent shall not extend beyond the expiration date of Pat. No. 5,727,269.

[21] Appl. No.: 844,613

[22] Filed: Apr. 21, 1997

[51] Int. Cl.[6] ..... A47C 27/10; A47C 27/08

[52] U.S. Cl. ..... 5/687; 5/685

[58] Field of Search ..... 5/680, 678, 681, 5/682, 685, 687, 665, 422

[56] References Cited

U.S. PATENT DOCUMENTS 4,310,936 1/1982 Benjamin ..... 5/687

4,558,476 12/1985 Linder ..... 5/682

4,638,518 1/1987 Barbulla ..... 5/687

4,901,386 2/1990 Lane ..... 5/687

*Primary Examiner*—Alexander Grosz

*Attorney, Agent, or Firm*—Beveridge, DeGrandi, Weilacher & Young, LLP

[57] ABSTRACT

A water bag for a water bed, including a hollow shell dividing into two inflating chambers at two oposite ends and a plurality of transverse water chambers between the inflating chambers, and a plurality of air bags longitudinally mounted in the transverse water chambers in parallel and respectively connected between the inflating chambers.

1 Claim, 6 Drawing Sheets

WATER BAG OF A WATER BED

BACKGROUND OF THE INVENTION

The present invention relates to water beds, and more particularly to a water bag for a water bed which has air bags on the inside adapted for absorbing water waves and regulating the stiffness of the water bed.

A variety of water beds have been disclosed, and have appeared on the market. A conventional water bed is generally comprised of a flexible frame, and at least one water bag mounted inside the frame. Regular water bags for water beds commonly define one water chamber only. When a water bag is installed in a water bed, water tends to be forced to vibrate. Therefore, the sealing edges of conventional water bags for water beds tend to be damaged, causing a water leakage.

SUMMARY OF THE INVENTION

The present invention has been accomplished to provide a water bag for water beds which eliminates the aforesaid problems. It is one object of the present invention to provide a water bag which is divided into a plurality of transverse water chambers, that are arranged in parallel and disposed in communication with one another. It is another object of the present invention to provide a water bag which has air bags adjustably inflated to regulate the stiffness of the water bag and to absorb water waves. It is still another object of the present invention to provide a water bag which is inexpensive to manufacture, and can be used for making a single water bed or a double water bed.

DETAILED DESCRIPTION OF THE PREFERRED EMBODIMENT

Figure 1:
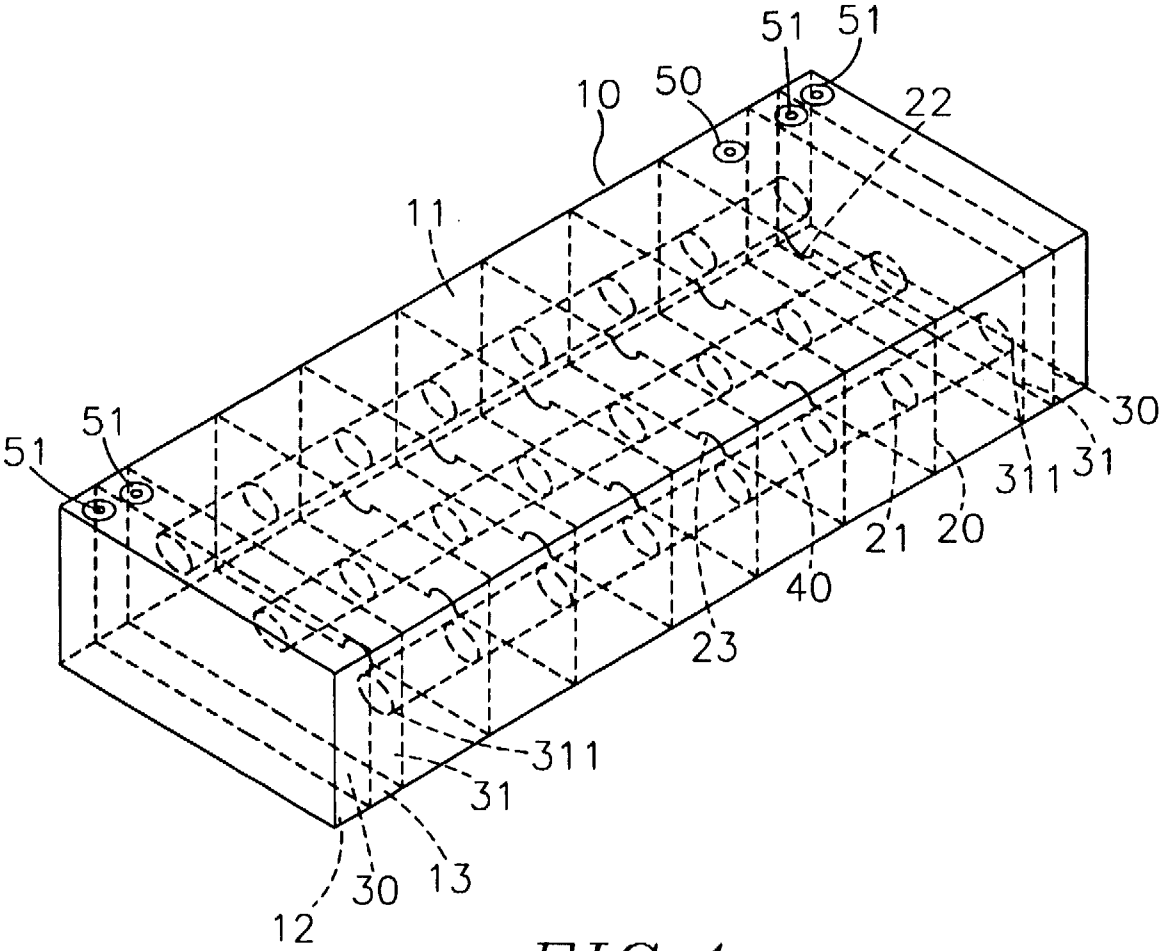
FIG. 1 is a perspective view of a water bag according to the present invention.
Figure 2:
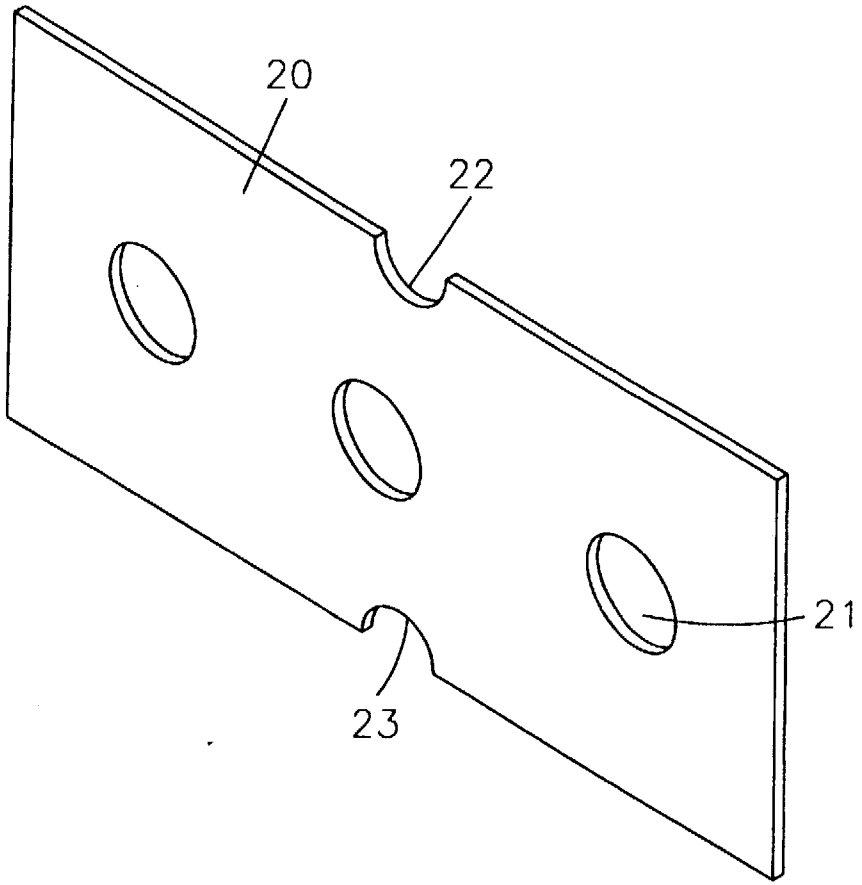
FIG. 2 is an elevational view in an enlarged scale of a buffering partition board according to the present invention.
Figure 3:
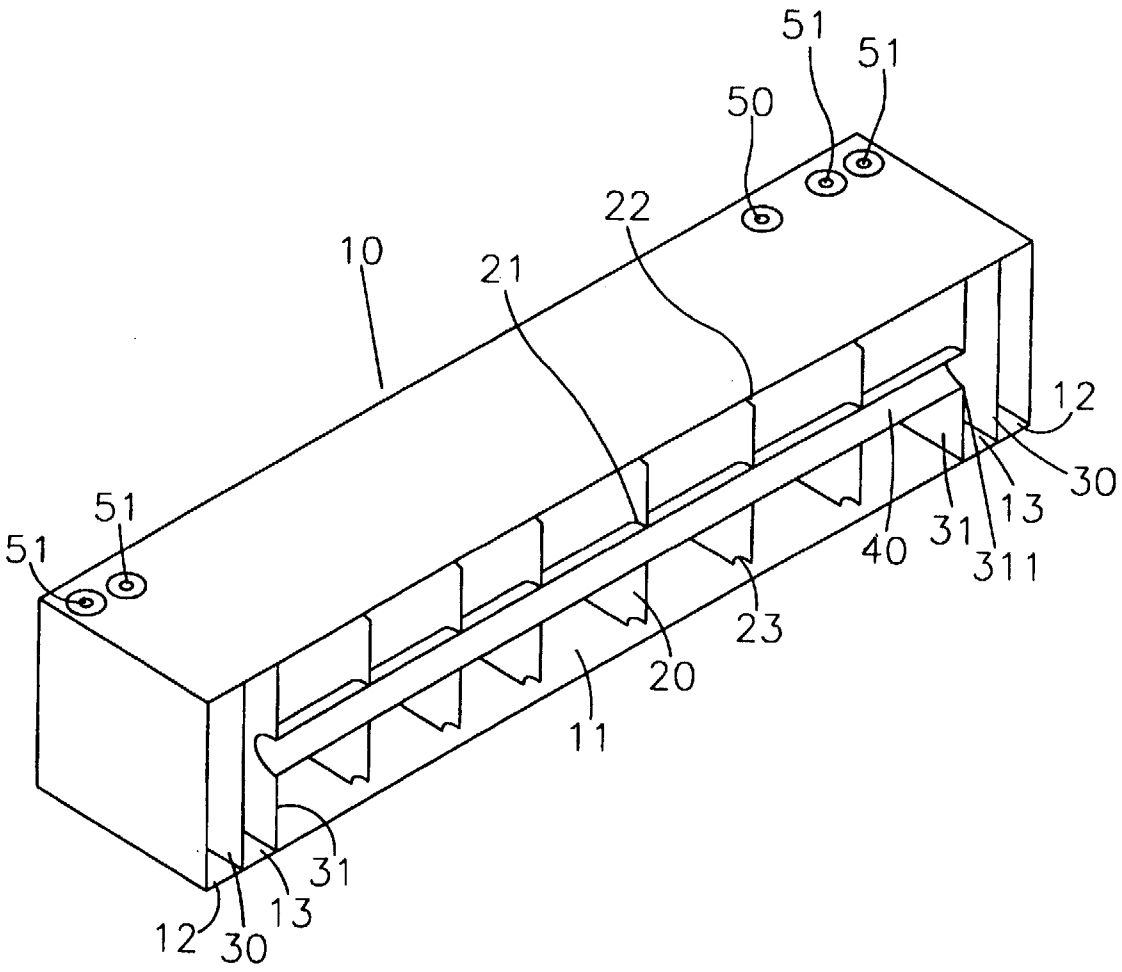
FIG. 3 is a cutaway of the water bag shown in FIG. 1.
Figure 4:
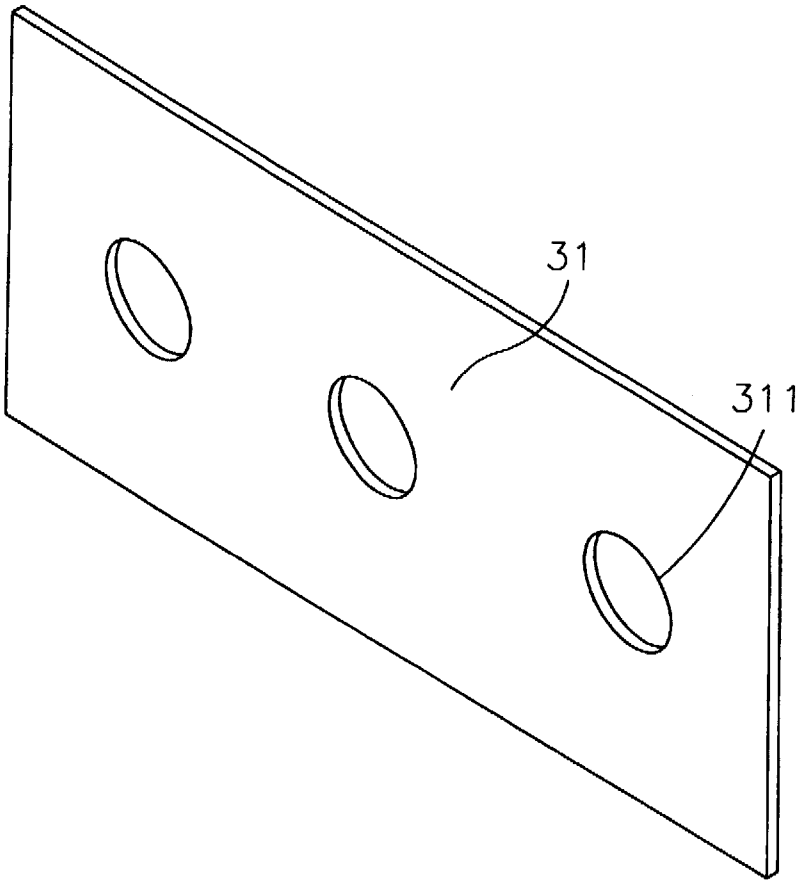
FIG. 4 is an elevational view in an enlarged scale of an air chamber partition board according to the present invention.

Referring to Figures from 1 to 4, a water bag of a water bed in accordance with the present invention is generally comprised of a hollow rectangular shell 10, a plurality of buffering partition boards 20, two packing boards 30, two air chamber partition boards 31, and a plurality of air bags 40.

The inside space of the shell 10 is divided by the buffering partition boards 20 into a plurality of transverse water chambers 11. The buffering partition boards 20 are fastened to the inside wall of the shell 10 by a high-frequency heat sealing apparatus, and transversely arranged in parallel. Each buffering partition board 20 has a plurality of locating holes 21, an exhaust hole 22 at the top, and a water filling hole 23 at the bottom. The air bags 40 are respectively mounted in the locating holes 21 of the buffering partition boards 20 inside the shell 10, and longitudinally arranged in parallel. The packing boards 30 are welded to the inside wall of the shell 10 near its two opposite ends by a high-frequency heat sealing apparatus, and defining with the two opposite ends of the shell 10 two independent end chambers 12, which keep the two opposite ends of the shell 10 in shape. Two air chamber partition boards 31 are welded to the inside wall of the shell 10 by a high-frequency heat sealing apparatus, and spaced between the buffering partition boards 20 and the packing boards 30, defining with the packing boards 30 two inflating chambers 13. Each air chamber partition board 31 has a plurality of air filling holes 311. The air bags 40 have respective two opposite ends respectively connected to the air filling holes 311 of the air chamber partition boards 31.

When water is filled into the water chamber 11 in the shell 10 through a water valve 50, water flows from one water chamber 11 to another through the water filling holes 23 underneath the buffering partition board, until all of the water filling chambers 11 are filled. After filling process is complete, residual air can be drawn out of the water chamber 11 through the exhaust holes 22 on top of the buffering partition board 20. The water filling holes 23 and the exhaust holes 22 can be used to adjust the pressure within the water chambers 11. If necessary, additional pressure relief holes can be installed for better use. During the inflation process, the air valves 51 allow air directly go into the inflating chambers 13 at either end of the water chamber 11. Additionally, air can go into several air bags 40 through the air filling holes 311. After the water chambers 11 have been filled, the inflation level of the air bags 40 can be used to determine the volume within the water chambers 11. By increasing or decreasing the water volume, users can adjust the hardness or softness of the water bed 10 according to their needs.

Because the air bags 40 are mounted on the buffering partition boards 20 inside the shell 10, when pressure is applied to the water bed 10, it creates waves which spread within water chambers 11 and into the air bags. At this point, all of pressure and waves from water chambers 11 compress the air bags 40 and thus increase the air density within the air bags and reduce the volume so that the compression force from the water chambers 11 can be absorbed and reduced protecting against bursting of the air bag 40. Therefore, because of this , water in the water chambers 11 does not sway easily. The force of the waves and kinetic energy of a neighboring water chamber 11 also offset both the pressure from kinetic energy and from applied force and serve to minimize pressure application. So this design produces the effect of enabling the bed to be more firm with a high degree of stability. The water bag does not cause a rush water wave when the user turns body.

Figure 5:
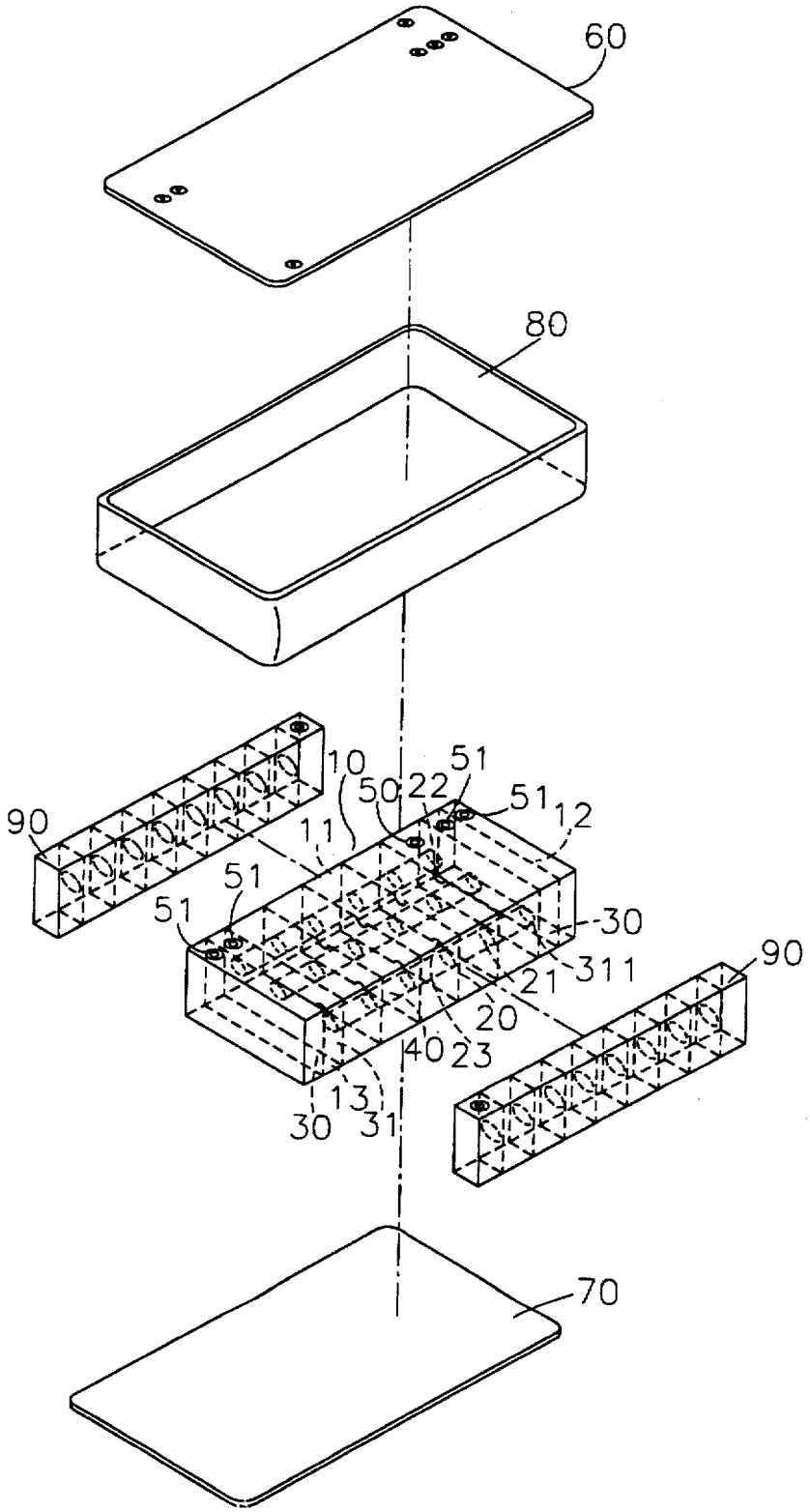
FIG. 5 is a perspective exploded view of a single water bed constructed according to the present invention.

FIG. 5 shows an application of the present invention for a single bed, in which a water bed 10 is mounted within a bed frame 80 with two side protection air bags 90, and covered with a bottom cover cushion 70 and a top cover cushion 60. They are sealed together by high-frequency heat sealing apparatus. The bed frame 10 can be mass produced in one size and adapted to make double or larger water beds.

Figure 6:
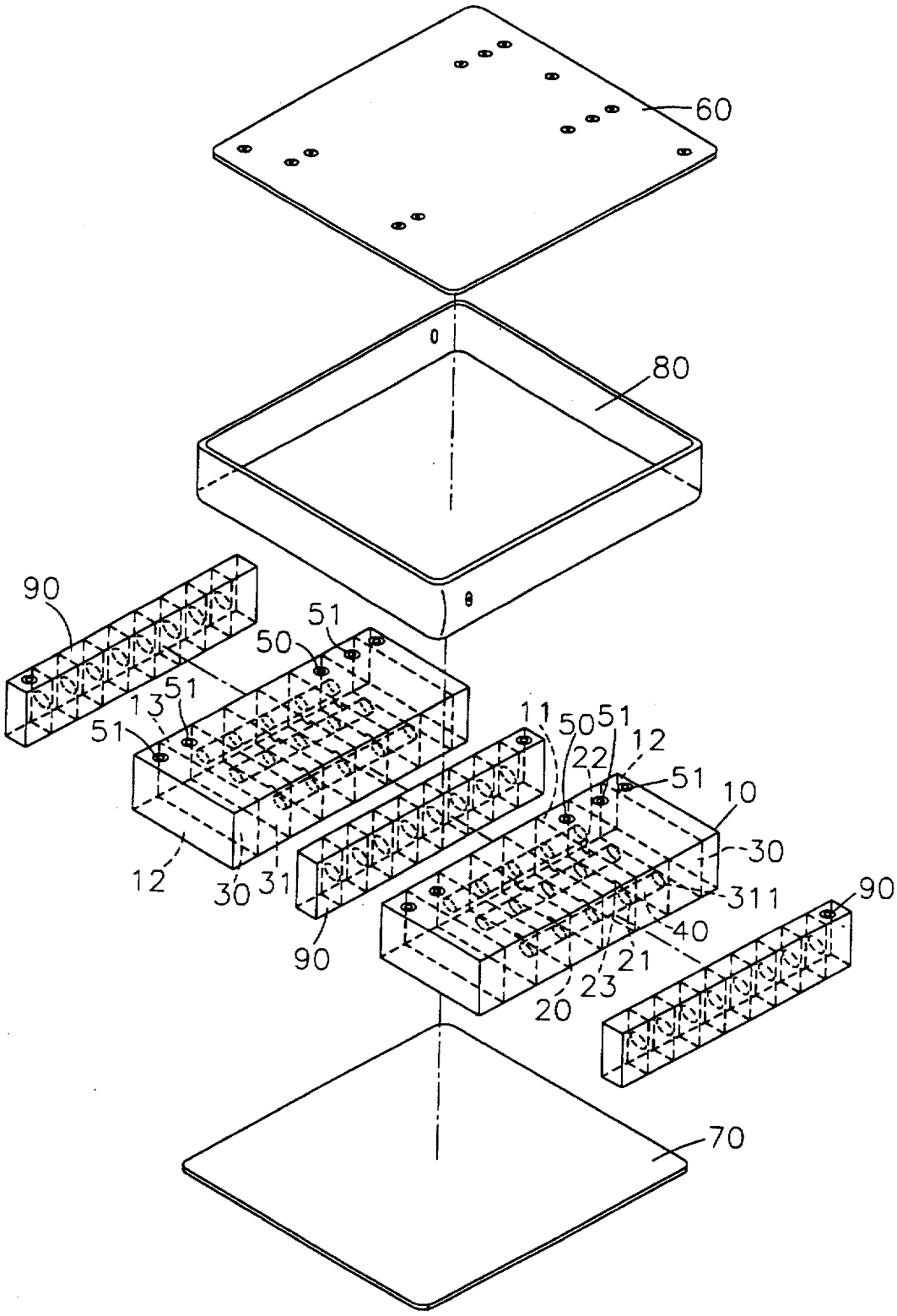
FIG. 6 is a perspective exploded view of a double water bed constructed according to the present invention.

FIG. 6 shows another application of the present invention for a double bed, in which two single water beds 10 and protection air bags 90 are alternatively mounted within a bed frame 80 with protection air bags 90 installed on both the outer edges of and between the two single water beds 10, and covered with a bottom cover cushion 70 and a top cover cushion 60. High-frequency heat sealing apparatus also is used to seal these parts, then a double water bed is completed. This kind of structure can easily be adapted for making a double or lager water beds with low-cost. Furthermore, heating elements may be installed and controlled to heat water in the water bed.

It is to be understood that the drawings are designed for purposes of illustration only, and are not intended as a definition of the limits and scope of the invention disclosed.

This invention can be summarized as follows:

1. This invention provides a mattress for a water bed which can be divided into several transverse water chambers containing several air bags. When a conventional water bed receives pounds of kinetic energy which creates waves and pounding, it easily sways and risks breaking, bursting or leakage. However, a water bed made using the present invention can disperse the pressure and kinetic energy into the water chamber and the air bags. When the air bags are compressed, the gas density increases and the volume decreases. This all has the result of dispersing the applied pressure or force. And the force of waves of a neighboring water chamber can offset some kinetic energy and pressure. The present invention can be used to reduce the danger of applying pressure, reduce risk of leakage, and to improve the stability of the bed.

2. After water is filled, the inflation level of the air bags can be adjusted. 90% in the water chambers is water and there remains 10% space. When 15% air is filled in through air bags, then the compression effect on the water is correspondingly less and this creates a feeling of sturdiness. This can enable the water bed to be springy, or create a calmer feeling. The user can freely adjust the hardness of the bed and can also minimize unsteadiness.

3. The invention can, using one standard of production, can be used to make a variety of different sized water beds.

4. This invention can be used in different kinds of water beds, and regular heating apparatus can be installed without modification.

From the preceding, one can determine that the structure of the present invention achieves a high degree of stability, reduces the effects of pressure, can be both easily and efficiently manufactured, can be adapted to most water beds. This invention is new and creative. According to patent law, we are filing a patent application in order to protect the rights of the inventor.

What the invention claimed is:

1. A water bag for a water bed, comprising:

a collapsible, hollow, rectangular, air-tight shell having two opposite ends;

a plurality of transverse buffering partition boards fastened in parallel to said air-tight shell on the inside and defining a plurality of transverse water chambers, each of said buffering partition boards having a plurality of locating holes;

two packing boards fastened to said air-tight shell and defining with the two opposite ends of said air-tight shell two independent end chambers, which when inflated keep the two opposite ends of said air-tight shell in shape;

two air chamber partition boards fastened to said air-tight shell on the inside and spaced between said buffering partition boards and said packing boards, and defining with said packing boards two inflating chambers, each of said air chamber partition boards having a plurality of air filling holes;

a plurality of air bags respectively mounted in the locating holes of said buffering partition boards, and having respective air inlets respectively connected to the air filling holes of said air chamber partition boards; and air valve means mounted in said air-tight shell through which air is filled into said inflating chambers and said end chambers separately.

* * * * *